US007581485B2

(12) United States Patent
Riedel

(10) Patent No.: US 7,581,485 B2
(45) Date of Patent: Sep. 1, 2009

(54) WORKING CYLINDER WITH TERMINAL POSITION DAMPING

(75) Inventor: Ralph Riedel, Rheinberg (DE)

(73) Assignee: Norgren GmbH, Alpen (DE)

( * ) Notice: Subject to any disclaimer, the term of this patent is extended or adjusted under 35 U.S.C. 154(b) by 154 days.

(21) Appl. No.: 11/486,491

(22) Filed: Jul. 14, 2006

(65) Prior Publication Data

US 2007/0012532 A1 Jan. 18, 2007

(30) Foreign Application Priority Data

Jul. 14, 2005 (DE) ..... 10 2005 032 853

(51) Int. Cl.
*F15B 15/22* (2006.01)

(52) U.S. Cl. ..... 91/395

(58) Field of Classification Search ..... 91/394, 91/395

See application file for complete search history.

(56) References Cited

U.S. PATENT DOCUMENTS 2,786,452 A * 3/1957 Tucker ..... 91/395
3,067,726 A 12/1962 Williams
3,196,753 A 7/1965 Maurer
3,677,141 A * 7/1972 Lagerqvist et al. ..... 91/394
3,999,463 A 12/1976 Greenwood
4,301,714 A * 11/1981 Stenlund et al. ..... 91/394
5,307,729 A * 5/1994 Hedlund ..... 91/394
5,692,429 A * 12/1997 Sonntag ..... 91/395

FOREIGN PATENT DOCUMENTS

| | | |
|---|---|---|
| DE | 38 18 833 | 2/1989 |
| DE | 297 06 364 | 6/1997 |
| EP | 0 260 344 | 3/1988 |
| JP | 11-132203 | 5/1999 |

* cited by examiner

*Primary Examiner*—F. Daniel Lopez
(74) *Attorney, Agent, or Firm*—Leydig Voit & Mayer, Ltd.

(57) ABSTRACT

A working cylinder with end position damping which has at least one telescoping damping pin, which upon the approach to the corresponding end position of the piston plunges into a receiving opening, which closes off a damping chamber and forms a damping element, in an end part of the working cylinder or in the piston.

21 Claims, 7 Drawing Sheets

WORKING CYLINDER WITH TERMINAL POSITION DAMPING

FIELD OF THE INVENTION

The invention relates to a working cylinder with end position damping, which has a cylinder body that contains a cylinder chamber, the cylinder body for instance being in the form of a tube or an extruded profile section; two end parts that close the cylinder on its ends; a piston supported longitudinally displaceably in the cylinder chamber between two end positions; and a device for damping the motion of the piston upon the approach to a at least one of its end positions.

BACKGROUND OF THE INVENTION

Pressure medium-actuated working cylinders often have end position damping to assure impact-free working action of the working cylinder. One example of such a pressure medium-actuated working cylinder with end position damping is described in U.S. Pat. No. 6,758,127. In this working cylinder, an axially protruding, tubular, cylindrical damping pin is provided on each of the two face ends of the piston, and associated with the damping pin is a receiving opening in the respective end piece, toward it, of the cylinder body, into which opening the damping pin plunges upon the approach of the piston to its end position. The receiving opening is in communication with a device for throttled the diversion pressure medium enclosed in the damping chamber. The length of the path that the piston travels upon approach to an end position, from the position in which the damping pin is just beginning to penetrate into the receiving opening and closes the damping chamber, until the position in which the piston has reached its actual terminal position and for instance rests with its face end on the face end of the associated end part, is called the damping stroke. The length of this damping stroke is predetermined by the axial length of the damping pin and hence by the depth of the receiving opening, which in turn is limited by the axial dimensions or in other words the thickness of the end part. Since the installed length of a working cylinder is often predetermined, for instance by standards, for a given piston stroke, the damping stroke cannot be made arbitrarily long.

On the other hand, particularly when relatively large masses are in motion, a longer damping distance, or in other words a longer damping stroke, is appropriate, since by that means the kinetic energy of the moving masses can be better dissipated, which leads to lesser reaction forces on the subconstruction and usually also improves adjustability, especially with additional elements. In an end position—damped working cylinder known from German Utility Model DE 297 06 364 U1, the main piston of the working cylinder is preceded by a control piston, which carries a ring magnet and which is connected to the main piston via cone springs and slides displaceably on the piston rod. The control piston simultaneously serves a blocking device and as a valve for outflow conduits, and upon contact of the control piston with the respective end part of the working cylinder, a damping impoundment chamber is embodies, from which fluid can flow away via a throttled outflow bore. Although this working cylinder does have a longer damping path or stroke in comparison to the aforementioned prior art, nevertheless the cone spring requires additional installation space, which is in addition to the fact that the use of spring elements, because of their limited service life, is problematic in many applications.

OBJECTS AND SUMMARY OF THE INVENTION

It is therefore the object of the invention to create a working cylinder with end position damping whose damping device is distinguished by a simple, operationally reliable construction and which, with a limited installed length of the entire working cylinder, has a long damping stroke.

For attaining this object, in the novel working cylinder, the device for damping the motion of the piston upon the approach to at least one of its end positions has two cooperating damping elements, of which one is provided on an end part of the working cylinder and the other is provided on the piston, on its side toward that end part. The two end parts, upon the approach of the piston to its end position, close a damping chamber, which communicates with a device for throttled diversion of pressure medium enclosed in the damping chamber. To that end, the two damping elements are insertable axially into one another in telescoping fashion in the direction of the piston motion, for instance in that one of the two damping elements has a receiving opening embodied in the end part or the piston, and the other has a telescoping damping pin that is insertable in sealed fashion into the receiving opening. In a preferred embodiment, the damping pin has a sleeve, which is supported in limited axial displacement on a rodlike bearing part that protrudes axially toward the piston or the end part. In a working cylinder that has a piston rod extended through an end part, the bearing part can directly be part of the piston rod.

Of the two damping elements that are insertable into one another upon the approach of the piston to its end position, as least one is supported for limited longitudinal displacement on the end part or the piston between two axially spaced-apart terminal positions with respect to the piston or the end part as applicable. Both damping elements are provided with cooperating inhibiting means, under whose influence the longitudinally displaceable damping element, upon a movement of the piston away from its end position, is adjustable into a terminal position, which is farther away from the piston than a first terminal position that the damping element normally assumes. The displaceability of the one damping element relative the piston or the end part produces an additional damping stroke by a telescoping action of the parts sliding in one another upon the approach of the piston to its end position. The inhibiting means assure that upon the motion of the piton away from its end position, the longitudinally displaceable damping element returns to its outset position without requiring additional actuation devices, such as spring elements or the like, for doing so. Hence no additional installation space is needed. The simple construction moreover allows the use of parts produced on a near-mass-production basis even for long damping strokes, that is, long damping paths.

The working cylinder may be either a single- or double-acting working cylinder, with a piston rod extended through at least one of its end parts, but the concept of the invention can also be applied equally to cylinders without piston rods. The working cylinders are as a rule pressure medium-actuated, for instance being pneumatic cylinders, but a corresponding device for end position damping can also be provided in working cylinders or linear drives that have a different form of actuation, for instance via Bowden cables and the like.

Other objects and advantages of the invention will become apparent upon reading the following detailed description and upon reference to the drawings, in which:

Figures 1, 3:
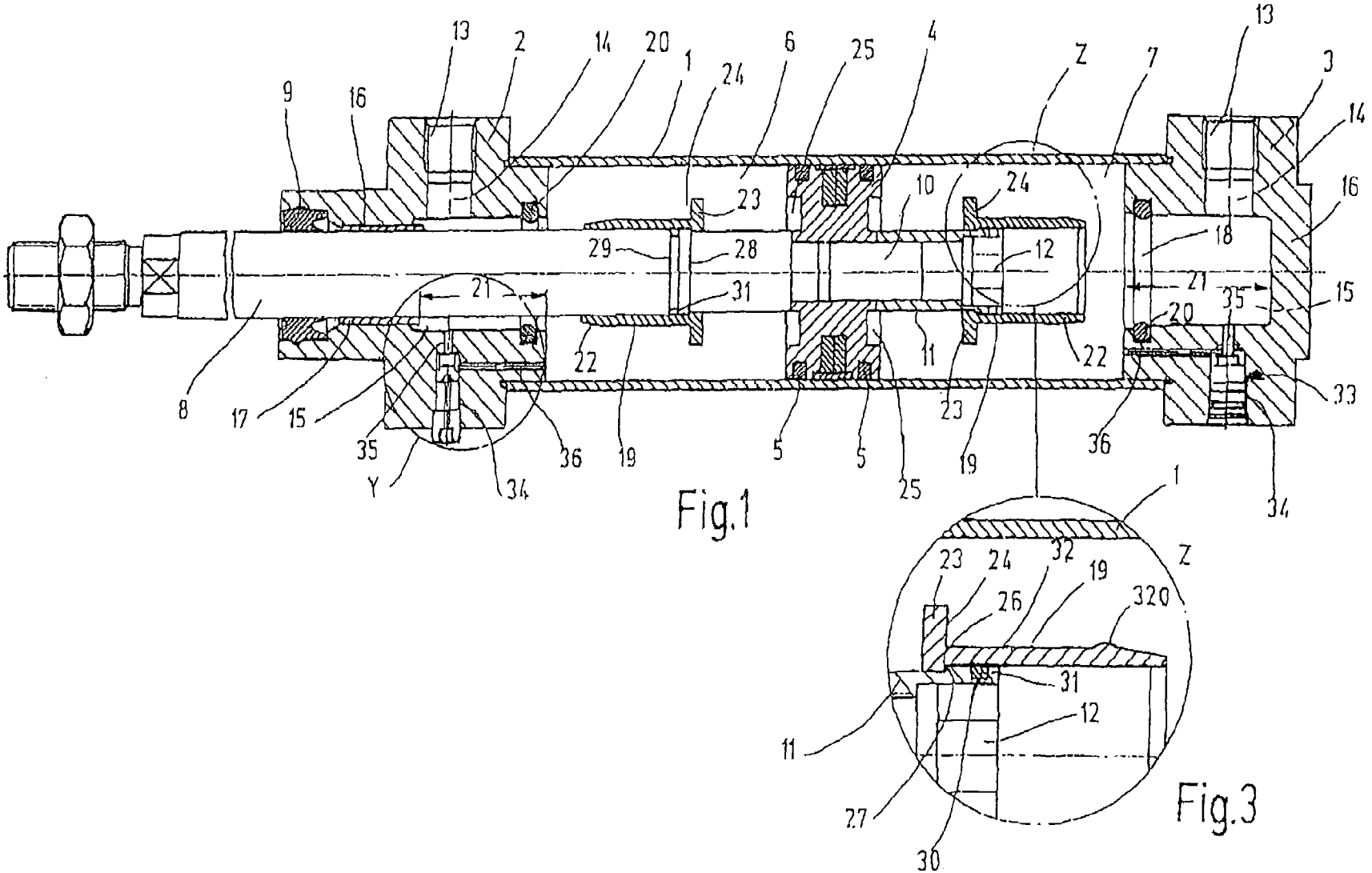
FIG. 1 is a longitudinal section of a working cylinder in accordance with the invention, showing a middle stroke position of a piston of the working cylinder.
FIG. 3 is an enlarged view of a detail "Z" of the working cylinder of FIG. 1.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DESCRIPTION OF THE PREFERRED EMBODIMENTS

Referring now more particularly to FIGS. 1-7 of the drawings, there is shown an illustrative working cylinder in accordance with the invention, which is in the form of a pneumatic cylinder having a cylinder body in the form of a cylindrical tube 1 and two end parts 2, 3 connected to the cylindrical tube 1 in a sealed fashion. The cylindrical tube 1 surrounds a cylinder chamber in which a piston 4, which is sealed off from the inner wall of the cylindrical tube 1 via piston ring seals, is longitudinally displaceably. The piston 4 divides the cylinder chamber into two cylinder or pressure compartments 6, 7, which are separated by the piston 4.

A coaxial cylindrical piston rod 8 is fixed to the piston 4 and is guided through the end part 2 in sealed fashion. A piston rod seal is shown at 9. The piston rod 8 that crosses through the cylinder compartment 6 is lengthened on the diametrically opposite side of the piston. On its lengthened portion 10, a coaxial cylindrical bush 11 protrudes into the cylinder compartment 7 and is fixed to the piston 4 by a screw 12 that is screwed to the lengthened portion 10 of the piston rod.

One connection conduit 14, opening into a threaded bore 13, is provided in each of the two end parts 2, 3 and can be made to communicate, via a corresponding screwed-in connection fitting, with a compressed air source, or a ventilator, in each case via suitable valves, and which on its other sides opens into a respective cylindrical, cup-shaped receiving opening 15, which discharges into the cylinder compartment 6 and 7, respectively, on the side of the respective end part 2 and 3 oriented toward the piston 4. The receiving opening 15 is coaxial with the piston rod is closed on the side away from the piston 4 in both end parts 2, 3, which in the case of the end part 2 is achieved by the piston rod seal 9, while the receiving opening 15 in the other end part 3 is closed off by an integrally formed-on bottom part 16. Each of the two receiving openings 15 contains an elastic sealing element, in the form of an O-ring 20, that extends all the way around in an annular groove 18 in the vicinity of the mouth of the receiving opening. The axial depth of the two receiving openings 15 is as a rule the same and is dimensioned such that a maximum depth 21 is achieved without increasing the installed length of the working cylinder.

The receiving opening 15 in each of the two end parts 2, 3 forms a respective damping element of a device for end position damping of the piston 4. For that purpose, it cooperates with a second damping element, which is provided on the piston 4 and has a respective telescoping damping pin, which upon the approach of the piston to its respective end position is insertable in sealed fashion into the respective receiving opening 15, in order to define a damping chamber, which encloses pressure medium which effects a pneumatic damping of the piston motion upon the throttled outflow from the receiving opening.

The second damping element, cooperating with the receiving opening 15, has a cylindrical sleeve 19, which is supported for limited axial longitudinal displacement on the piston rod 8 on the side of the piston 4 toward the end part 2 on the cylindrical bush 11 on the side of the piston toward the other end part 3. On its side toward the respective end part 2, 3, the sleeve 11 is chamfered on the outside at 22, while on its diametrically opposed end it is formed with an annular flange 23, which defines a stop face 24 oriented toward the respective end part 2, 3. In the face end of the piston toward it, the annular flange 23 of each of the two sleeves 19 has a respective annular groove 25, which is capable of receiving the entire annular flange 23, as will be described in detail hereinafter.

Figure 6:
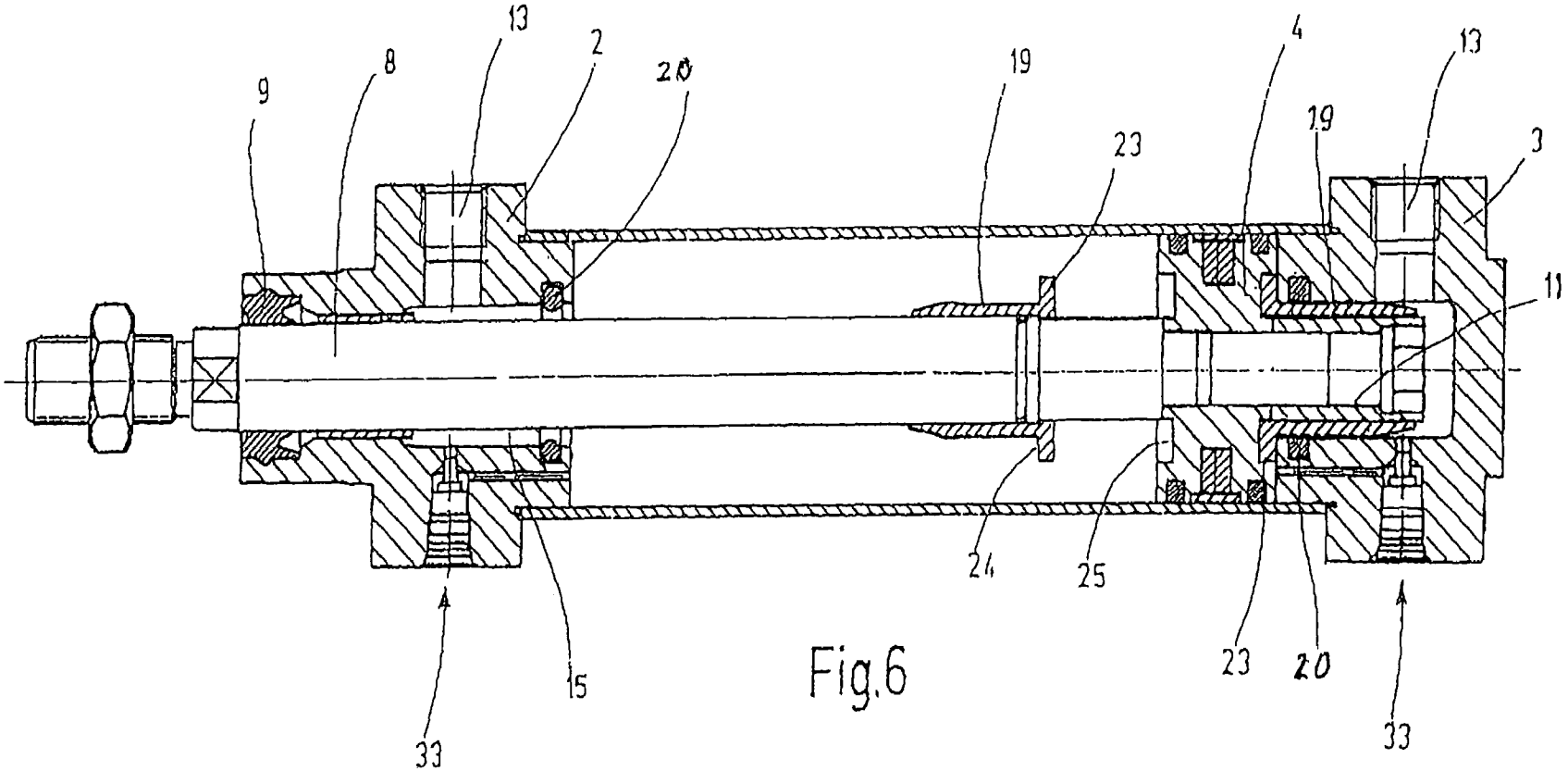
FIG. 6 shows the working cylinder of FIG. 1 in a corresponding sectional view, showing a stroke position of the piston in which the piston has reached its end position.

As can be seen particularly from the detail "Z" in FIG. 3, each sleeve 19, in the region of its inner wall, has an annular shoulder 26, which cooperates with a corresponding annular shoulder 27 near the free end of the tube 11 on one side of the piston and with an annular shoulder 28 on the piston rod 8 on the other side of the piston. The annular shoulders 27, 28 are spaced apart from the respective adjacent face end of the piston so far, and are adapted in such a way to the length of the sleeve 19, that in the first terminal position, far from the piston, shown in FIG. 1, in which the annular shoulders 26, 27 and 26, 28 rest on one another, the two sleeves 19 with their annular flange 23 are at the same axial spacing from the adjacent face end of the piston, and that in a second terminal position, near the piston, the flange 24 is in each case received entirely in the respective annular groove 25, as is shown in FIG. 6 for the sleeve 19 associated with the end part 3.

In the first terminal position shown in FIG. 1, the two sleeves 19 are unlocked. The associated detent device has a detent element, in the form of an O-ring 31, which is in an annular groove 29 and 30 of the piston rod 8 and the bush 11, respectively, and which elastically resiliently cooperates with a detent indentation 32 on the inner wall of the sleeve 19. In the first terminal position shown, the sleeve 19 adjacent to the end part 3 protrudes axially past the bush 11 over a great proportion of the length of the sleeve, while the other sleeve 19, over the greatest proportion of its length, rests on a portion of larger diameter of the piston rod 8. Instead of the detent locking, a frictional engagement locking of the sleeves may be employed.

An annual bead 320 extending all the way around furthermore is provided on the two sleeves 19, for instance adjoining the chamfer 22; it can cooperate with the respective O-ring 20 in the end part 2 and 3, respectively, and together with this O-ring it forms inhibiting means for the axial motion of the sleeve 19 oriented away from the respective end part, as will be described below.

The two receiving openings 15 in the end parts 2, 3 each are provided with a device for throttled diversion of pressure medium enclosed in the damping chamber that is surrounded by the piston 4, the cylinder chamber 6 or 7 and the end part 2 and 3, respectively. In the illustrated embodiment, this device includes a throttle valve 33, which is shown in its details in the detail "Y" in FIG. 2. The throttle valve 33 is inserted into a corresponding bore 34 in the respective end part 2 and 3, which communicates with the receiving opening 15 via a coaxial conduit 35 and with the cylinder compartment 6 and/or 7 via a laterally outgoing conduit 36.

Figure 2:
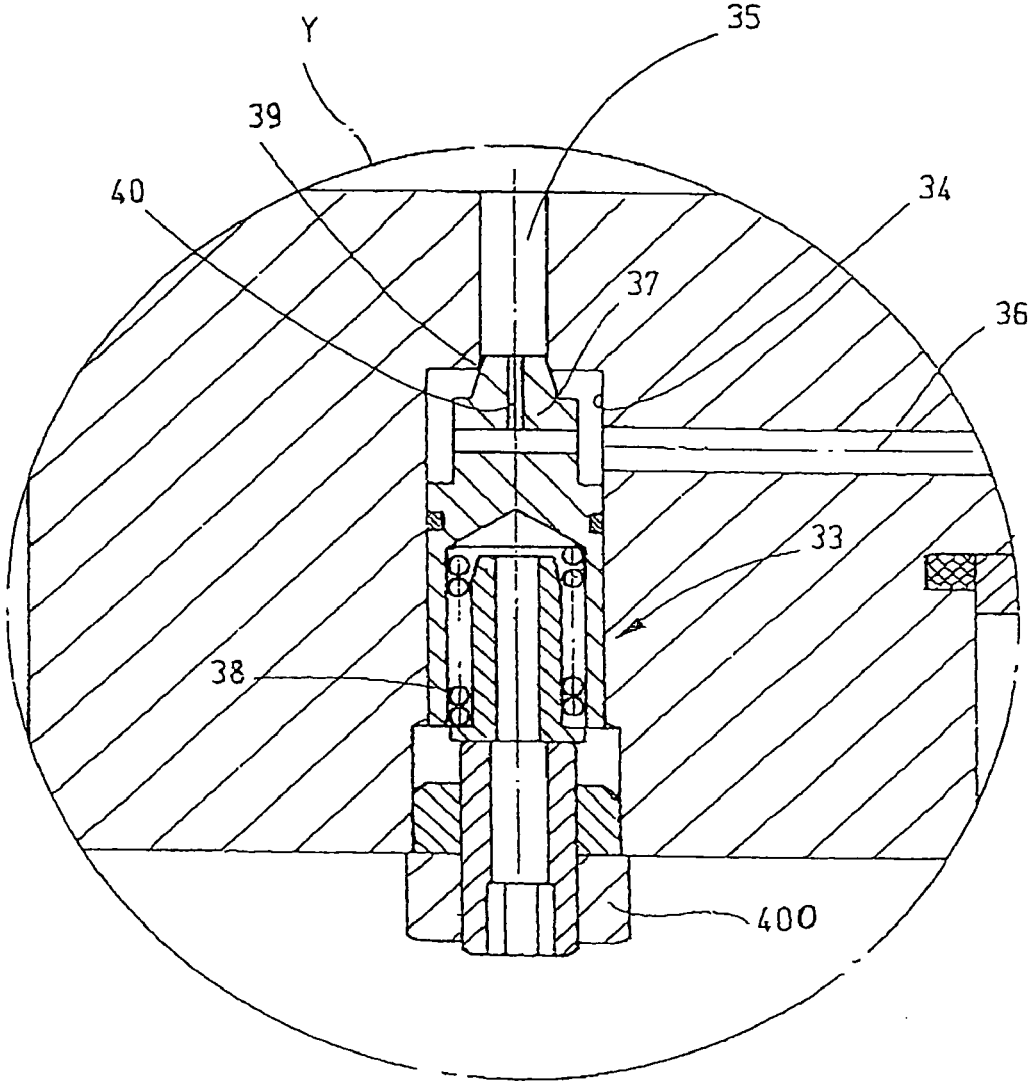
FIG. 2 is an enlarged view of a detail "Y" of the working cylinder of FIG. 1.

The throttle valve 33 has a valve body 37, which is pressed elastically by a valve spring 38 against a valve seat 39; the valve spring 38 being braced axially against a stopper 400 screwed into the bore 34. The valve body 37 in this case is in the form of a differential piston. If the same pressure of the pressure medium prevails in both conduits 35, 36, then the valve spring 38 can keep the valve body 37 on the valve seat 39 and can thus keep the throttle valve closed (FIG. 2). If the pressure rises in the damping chamber, and thus in the conduit 35, by a preset value, then the valve body 37 is correspondingly lifted from the seat 39. A throttle conduit 40 of relatively small diameter is formed in the valve body 37, and by way of it, when the valve is closed, air can flow out of the damping chamber into the adjacent, pressureless cylinder chamber 6 or 7 as applicable. The throttle conduit 40 acts as a bypass conduit.

The end position damping of the working cylinder described functions as follows:

In the middle stroke position of the piston 4, shown in FIG. 1, the two sleeves 19, each acting as a longitudinally displaceable damping element, are shown in their terminal position remote from the piston, in which position they are locked by the two O-rings 31 acting as detent elements. The annular shoulders 26, 27 and 26, 28 rest on one another and define the first terminal position, remote from the piston, of the sleeves 19 relative to the piston 4.

Figure 4:
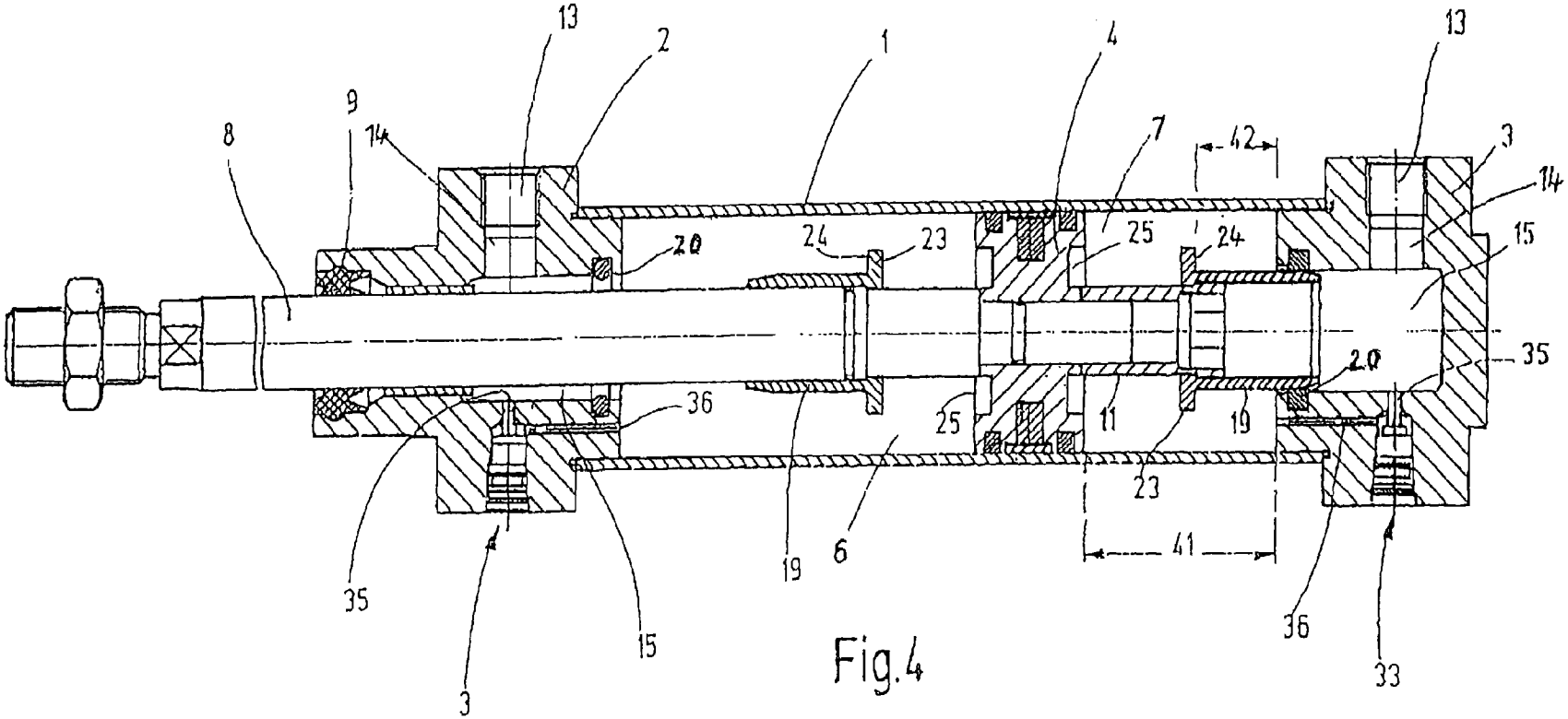
FIG. 4 shows the working cylinder of FIG. 1 in a corresponding sectional view, showing a stroke position of the piston in which the two damping elements of the end position damping device are just entering into engagement with one another.

In the stroke position shown in FIG. 4, the piston 4 has moved so far to the right compared to FIG. 1, as a result of suitable imposition of compressed air on the cylinder compartment 6 and venting of the cylinder compartment 7, that the piston rod 8 has been driven almost all the way into the working cylinder, and the sleeve 19 on the right is just now coming into engagement with the O-ring 20, forming an inhibiting means, of the receiving opening 15 of the end part 3. This initial action of engagement is promoted by the chamfer 22 of the sleeve 19. The sleeve 19 and the bush 11, closed by the screw 12 and sealed off from the sleeve via the O-ring 31, close off the receiving opening 15 via the O-ring 20 and cause a damping chamber for the piston 4 to be created. Simultaneously, the free outflow of pressure medium from the cylinder compartment 7 via the connection conduit 14 is prevented. Now, pressure medium can flow out of the cylinder compartment 7 via the damping conduits 36, 40, 35 and the adjustable damping throttle valve 33.

If the piston 4, the piston rod 8, and a mass connected to them move at a certain speed onward in the direction of the end part 3, then, because of the throttled outflow of the pressure medium from the cylinder compartment 7, a pressure increase takes place in the cylinder compartment 7, which acts counter to the motion; in other words, damping of the motion of the piston 4 upon its approach to its end position takes place.

Figure 5:
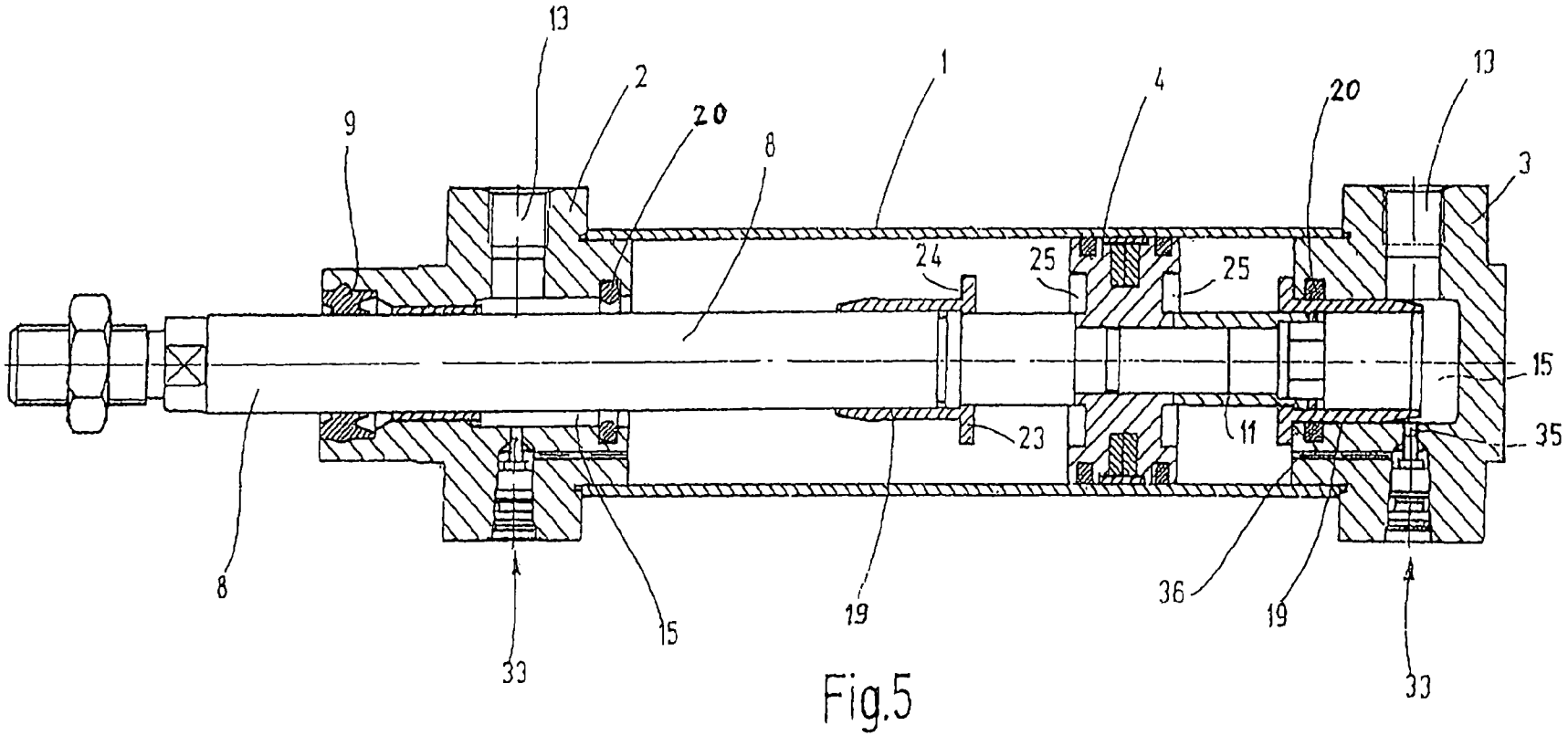
FIG. 5 shows the working cylinder of FIG. 1 in a corresponding sectional view, showing a stroke position of the piston in which the two damping elements of the end position damping device are inserted all the way into one another.

In a further course of the approach to its end position, the piston 4 reaches the stroke position shown in FIG. 5, in which the longitudinally displaceable damping element, in the form of the sleeve 19, has moved all the way into the receiving opening 15 and is thus plunged all the way into the end part 3. The stop face 24 of the annular flange 23 strikes the associated end face of the end part 3, so that the sleeve 19 is locked by positive engagement. If the rightward motion of the piston 4 is continued, the detent action of the O-ring 31 acting as a detent element is therefore overcome, so that finally, the piston 4 can reach the end position shown in FIG. 6, in which the entire annular flange 23 of the sleeve 19 is received in the annular groove 25 of the piston, and the piston rests with its face end on the face end of the end part 3.

In this end position of the piston 4, the sleeve 19, over practically its entire length, is slipped onto the bush 11 and the screw 12 protrudes axially past the sleeve 19 slightly, as can be seen from FIG. 6.

From a comparison of FIGS. 4 and 6, the length of the damping stroke can be found:

The travel by the piston 4, from the stroke position in which the damping chamber in the cylinder compartment 7 has just been formed until the end position in FIG. 6, is called the damping stroke 41. If, as in principle is true of the prior art, only one unitary damping pin were connected with the piston 4, the result would be only the damping stroke shown at 42 in FIG. 4 (a short distance), which is determined essentially by the axial length of the sleeve 19, calculated from the stop face 24. Since the sleeve 19 is longitudinally displaceable on the bush 11, the result is a telescoping action by which the damping stroke 41 is increased to almost twice the length of the aforementioned damping stroke 42. Without such telescoping, for the same axial length of the working cylinder, only a damping stroke 42 would be possible. As indicated at the outset, particularly with large masses, a longer damping distance is better, since among other effects this contributes to a better, impact-free dissipation of the kinetic energy.

Figure 7:
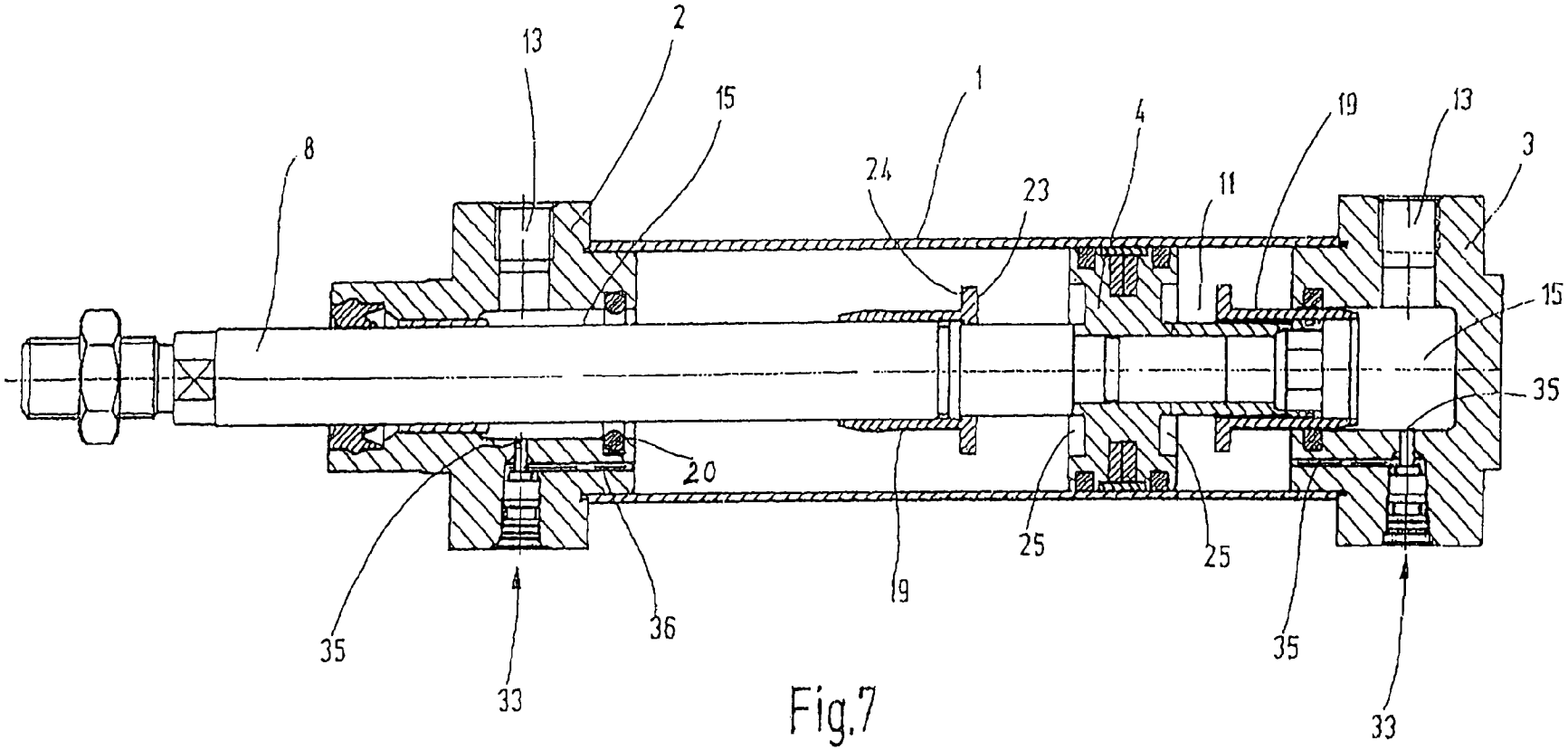
FIG. 7 shows the working cylinder of FIG. 1 in a corresponding sectional view, showing a stroke position of the piston in which the piston has moved partly away from its end position again.

If the piston rod 8 moves to the left again, beginning at the end position in FIG. 6, then the sleeve 19 is initially pulled out of the receiving opening 15, since via the O-ring 31 it is coupled by frictional engagement to the bush 11 and thus to the piston 4. In the course of this outward-extending motion, however, the bead 320 runs up against the O-ring 20, forming an inhibiting means that prevents the sleeve 19, which has already been pulled predominantly out of the receiving opening 15, from leaving the receiving opening 15 completely (FIG. 7). In the further outward-extending motion of the piston 4, the bush 11 is therefore pulled out of the fixedly held sleeve 19, until the annular shoulders 26, 27 rest on one another and thus, if the outward-extending motion continues, the detent locking action formed by the O-ring 20 and the bead 32 is overcome. It is thus assured that the sleeve 19, forming the displaceable damping element, will be returned to its first terminal position, remote from the position, so that in the next inward motion that occurs, it is again in the correct outset position shown in FIG. 1, and thus the full damping length 41 is available.

The end position damping has been described above in conjunction with the approach of the piston 4 to the end part 3 remote from the piston rod 8. The conditions upon the approach of the piston to the other end part 2 are the same so that repeated explanation of that function is unnecessary.

The invention has been described above in conjunction with a dual-action pneumatic cylinder that operates with a piston rod 8. In principle, it is also applicable to working cylinders without piston rods, as shown for example in FIG. 8.

Many versions of piston-rodless working cylinders are known. Examples of them are described in European Patent Disclosure EP 0 260 344 B1 and in U.S. Pat. No. 4,373,427. In such working cylinders, the pinlike damping element is often fixedly joined to the end parts of the cylinder, and upon the motion of the piston toward the end position, the damping element enters the piston. As the US patent shows, constructions that are the reverse of this have already been proposed, but that leads to correspondingly thick end parts. If the damping element is provided on the respective end part, then the space already present in the piston in these working cylinders is advantageously utilized for the pneumatic damping, and the end parts can be kept relatively short and independent of the damping length. The present invention makes it possible even in these cases to attain substantially longer damping paths without increasing the installed length of the cylinder, as can be seen from FIG. 8.

Only those parts of the working cylinder that are essential to the invention are explained and shown. The aforementioned references, the disclosures of which are incorporated herein by reference, may be consulted for the details. The tubular cylinder body 51 is closed on its ends by two end parts 52, 53 and surrounds a cylinder chamber, in which a piston 54 is longitudinally displaceable. The cylinder body 51 is provided with a longitudinal slit, through which a rib joined to the piston 54 leads outward to a force-transmitting element 55. The longitudinal slit is closed by an elastic sealing tape 56, which is in two parts and seals off the cylinder or pressure compartment 57, 58 from the outside on both sides of the piston 54. Each of the two end parts 52 has a tubular bearing part 59, which protrudes into the respective cylinder chamber 57, 58 and is oriented coaxially with the piston 54. On each bearing part 59, a sleeve 19 as in FIGS. 1 through 7 is supported for longitudinal displacement; associated with it is a coaxial cylindrical receiving opening 15 in the diametrically opposite face end of the piston 54. The sleeve 19 is designed and supported as shown particularly in FIG. 3. Identical elements are identified by the same reference numerals and need not be explained again.

Figure 8:
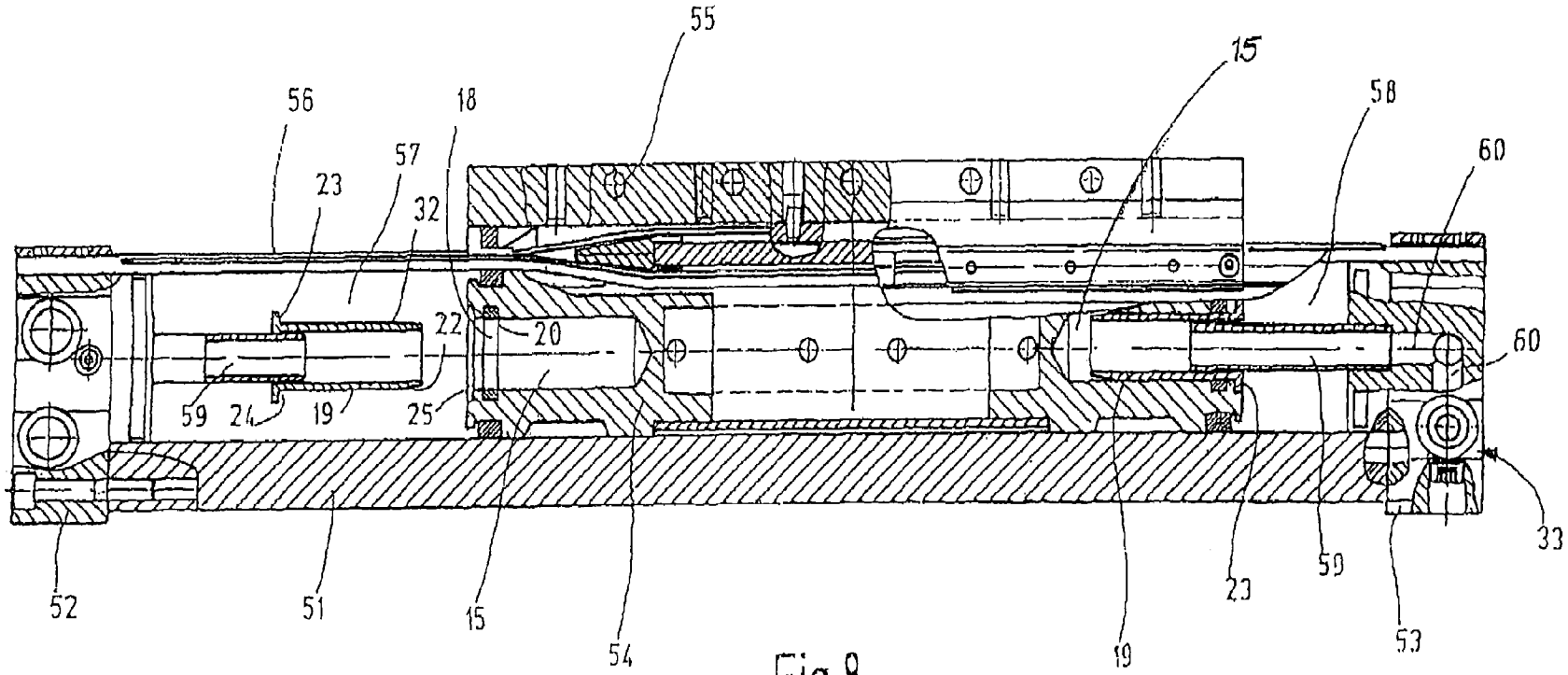
FIG. 8 is a longitudinal section of a piston-rodless working cylinder in accordance with the invention, showing a stroke position of the piston in which the piston is approaching its end position, and the two damping elements have already entered into engagement with one another.

The same is similarly true for the embodiment of the receiving opening 15, which extends axially in the form of a blind bore into the piston 54. The tubular bearing parts 59 in the end parts 52, 53 each discharge into a conduit 60, which leads to a throttle valve 33, similarly to that shown in FIG. 2. The construction and action of this valve has already described in conjunction with FIG. 2, so that once again a repeated explanation is unnecessary. FIG. 8 shows the piston-rodless working cylinder in a stroke position in which the left sleeve 19, forming a damping element, is in the outward-extended terminal position, or in other words is shown remote from the end part 52. Once again, detent locking, or optionally, merely frictional engagement between the bearing part 59 and the displaceable sleeve 19 keeps the displaceable damping element formed by them in the outward-extended position. Upon a motion of the piston in the direction of the left end position, the sleeve 19 is first thrust into the receiving opening 15, whereupon the sleeve itself is slipped farther in telescoping fashion on the bearing part 59 until it rests on the end part 52. Detent locking or a simple frictional engagement between the sleeve 19 and the O-ring 20 that forms the inhibiting means assures that the sleeve 19 forming the displaceable damping element is returned to the outward-extended terminal position, shown in FIG. 8, upon a piston motion away from the end part 52.

The invention has been described above in conjunction with throttle valve 33, which causes the throttling of the pressure medium flowing out of the respective cylinder compartment upon the approach of the piston to an end part and thus regulates the damping. Particularly in pneumatic cylinders with a relatively long damping path, it can be expedient, instead of such a throttle valve, to provide a pressure limiting valve, of the kind known for instance from U.S. Pat. No. 3,196,753 the disclosure of which is incorporated herein by reference. The combination of a lengthened damping stroke by telescoping as described with a pressure limiting valve brings about a substantial improvement in the adjustability of the pneumatic damping. Since pressure limiting valves close below a defined, set threshold value, it is expedient in this case to proved a parallel conduit (see conduit 40 in FIG. 2), by way of which the remaining air is diverted from the damping chamber to the connection conduit, so as to reach the end position of the piston quickly.

The invention claimed is:

1. A working cylinder with end position damping comprising:

a cylinder body (1) having a cylinder chamber into which a pressure medium is introduced, two end parts (2, 3, 52, 53) closing the cylinder chamber at its ends, a piston (4) supported for longitudinal displacement in the cylinder chamber between two end positions, a damping device for damping the motion of the piston upon the approach to at least one of its end positions, said damping device including two cooperating damping elements (15, 19), a throttling device communicating with a dampening chamber for the throttled diversion of pressure medium enclosed within a dampening chamber upon the approach of the piston to its end position, one of said damping elements including a receiving opening (15) formed in one of the one end part or the piston, and the other damping element including a telescoping damping pin (11, 19, 59) that is insertable in sealed fashion into the receiving opening upon movement of the piston in a direction toward its end position, the damping pin (19) being supported for limited longitudinal displacement on the other of the one end part (52, 53) or the piston (40) between two terminal positions axially spaced apart from one another with respect to one of the piston (4) or the other end part, and said damping elements cooperate upon the approach of the piston to its end position for adjustably positioning the displaceable damping element to a first terminal position near the piston (4) or end part (52, 53), and upon movement of the piston away from its end position the displaceable damping element is adjustably positioned to a second terminal position which is farther away from the piston (4) or the end part, and said damping elements (15,19) having engageable frictional elements therebetween for resisting movement of said damping elements relative to each other from the first position during movement of said piston away from its end position for returning said displaceable damping element to the second position axially spaced from said first position before the damping elements are completely withdrawn from an insertable condition solely by the engagable frictional elements.

2. The working cylinder of claim 1 in which one of the piston or end part has an axially protruding rodlike bearing part, and said damping pin includes a sleeve (19) which is supported for limited axial displacement on the rodlike bearing part.

3. The working cylinder of claim 2 in which said bearing part is a piston rod (8) which is connected to the piston (40) and extends axially through the end part out of the cylinder chamber.

4. The working cylinder of claim 2 in which said bearing part has a tube (59) connected to one of the end parts which communicates with the throttling device for the throttled diversion of pressure medium enclosed in the damping chamber.

5. The working cylinder of claim 2 in which said sleeve, in one of the terminal positions, is supported on the bearing part in axially extended relation to the end of the bearing part.

6. The working cylinder of claim 2 in which said damping pin (11, 19) has a stop which limits the extent the pin may enter into receiving opening (15).

7. The working cylinder of claim 6 in which said stop is in the form of a radial face (24) on said sleeve (19) which cooperates with a stop face on one of the end part (2, 3) or piston (4).

8. The working cylinder of claim 7 in which said stop face (24) on the sleeve (19) is an annular flange (23).

9. The working cylinder of claim 8 in which upon movement of said sleeve into said receiving opening said annual flange (23) of the sleeve is positionable into an indentation (25) in an end face of one of the end part (2, 3) or the piston (4).

10. The working cylinder of claim 1 in which said piston (4) is moveable to an end position with an end face substantially against an end face of end part (52, 53).

11. The working cylinder of claim 1 in which the frictional elements includes at least elastic member (20) on one damping element (15) which upon the approach of the piston to its end position is brought into frictional engagement with a surface of the damping pin (19).

12. The working cylinder of claim 11 in which said damping pin (19) includes a detent device that cooperates with the elastic member.

13. The working cylinder of claim 12 in which the detent device includes a bead (32) or indentation disposed on a surface of the damping pin.

14. The working cylinder of claim 1 in which the displaceable damping element (19) is frictionally retained in its terminal position that is remote from the piston or the end part.

15. The working cylinder of claim 1 in which the throttling device includes a pressure limiting valve.

16. The working cylinder of claim 15 in which the pressure limiting valve is selectively set at a threshold pressure valve.

17. The working cylinder of claim 15 including a pressure medium outflow conduit (40) is disposed in parallel relation to the pressure limiting valve.

18. The working cylinder of claim 1 in which a pair of said damping elements is provided at opposite ends of the cylinder body.

19. The working cylinder of claim 1 in which said piston is of a rodless type without a rod extending out of the end parts.

20. A working cylinder with end position damping comprising:

a cylinder body (1) having a cylinder chamber into which a pressure medium is introduced, two end parts (2, 3, 52, 53) closing the cylinder chamber at its ends, a piston (4) supported for longitudinal displacement in the cylinder chamber between two end positions, a damping device for damping the motion of the piston upon the approach to at least one of its end positions, said damping device including two cooperating damping elements (15, 19), a throttling device communicating with a dampening chamber for the throttled diversion of pressure medium enclosed within a dampening chamber upon the approach of the piston to its end position, one of said damping elements being axially insertable into the other of said damping elements upon movement of the piston in a direction toward its end position, the one damping element (19) being supported for limited longitudinal displacement between two terminal positions axially spaced apart from one another with respect to the piston, and said damping elements cooperate upon the approach of the piston to its end position for adjustably positioning the displaceable dampening element to a first terminal position near the piston (4), and upon movement of the piston away from its end position the displaceable damping element is adjustably positioned to a second terminal position which is farther away from the piston (4), and said damping elements (15,19) having engageable frictional elements therebetween for resisting movement of said damping elements relative to each other from the first position during movement of said piston away from its end position for returning said displaceable damping element to the second position axially spaced from said first position before the damping elements are completely withdrawn from an insertable condition solely by said engagable frictional elements.

21. The working cylinder of claim 1 in which one of said frictional elements is an O-ring on one of said damping elements and another of said frictional elements is a detent rib on the damping pin.

* * * * *